United States Patent [19]

Bankier

[11] Patent Number: 4,773,781

[45] Date of Patent: Sep. 27, 1988

[54] FAN-FOLD PAPER CATCHER FOR A PRINTER

[75] Inventor: Jack D. Bankier, Northbrook, Ill.

[73] Assignee: Bankier Companies, Inc., Northbrook, Ill.

[21] Appl. No.: 86,184

[22] Filed: Aug. 10, 1987

Related U.S. Application Data

[63] Continuation of Ser. No. 813,581, Dec. 26, 1985, abandoned.

[51] Int. Cl.[4] ..... B41J 11/26

[52] U.S. Cl. ..... 400/613.2; 270/39; 493/410

[58] Field of Search ..... 400/613.2, 613.3, 613.4; 493/410–412; 270/39–40; 226/199–200

[56] References Cited

U.S. PATENT DOCUMENTS

| | | | |
|---|---|---|---|
| 2,077,428 | 4/1937 | Mabon | 400/613.3 |
| 2,845,019 | 7/1958 | Stiefel | 400/613.3 |
| 2,973,081 | 2/1961 | Maidment et al. | 400/613.3 |
| 3,514,096 | 5/1970 | Muller | 493/410 |
| 3,712,607 | 1/1973 | Ziegler et al. | 270/39 |
| 4,530,689 | 7/1985 | Ringer, Sr. | 400/613.2 X |
| 4,541,749 | 9/1985 | McCoy | 400/613.2 |
| 4,681,468 | 7/1987 | Kallin et al. | 400/613.2 |

FOREIGN PATENT DOCUMENTS

| | | | |
|---|---|---|---|
| 3313201 | 10/1984 | Fed. Rep. of Germany | 493/410 |
| 1327170 | 4/1962 | France | 400/613.2 |

OTHER PUBLICATIONS

IBM Tech. Disclosure Bulletin, "Pivoting Forms Glide", vol. 20, No. 8, Jan. 1978, p. 3049.

*Primary Examiner*—Eugene H. Eickholt
*Attorney, Agent, or Firm*—Hill, Van Santen, Steadman & Simpson

[57] ABSTRACT

A paper collection tray for a printer, particularly for fan-fold paper discharged from the printer, is supported in a variety of angular dispositions by a body carried on a leg structure. The body also carries first and second paper guides for directing the paper discharged from the printer toward the rear, upwardly and then forwardly for disposition on the paper collection tray. The body is vertically adjustable on the leg structure to accommodate various heights of printers, including printers using printer stands, and is horizontally adjustable with respect to printer depth.

24 Claims, 4 Drawing Sheets

FAN-FOLD PAPER CATCHER FOR A PRINTER

This is a continuation of application Ser. No. 813,581, filed Dec. 26, 1985 and now abandoned.

BACKGROUND OF THE INVENTION

1. Field of the Invention

The present invention relates to a paper catcher for fan-fold paper output from a printer.

2. Description of the Prior Art

When a printer outputs printed paper, such as fan-fold paper, a problem arises as to the collection, stacking and the like of the paper. Heretofore, the paper was essentially guided to the rear of the machine and deposited on a table, on the floor or in a bin located to the rear of the machine. These techniques led to problems in the proper folding and stacking of the printed paper.

SUMMARY OF THE INVENTION

It is the object of the present invention to provide a paper catcher for a printer which ends the printout clutter noted above and which takes up a small space adjacent the printer.

According to the invention, the above object is achieved, by providing a paper collection tray which may be placed in a plurality of positions on a stand such that the tray extends above the top of the printer. The stand includes a body which is vertically adjustable on a pair of legs to accommodate any vertical height of the printer, the body of the stand being removable and the legs may be folded down out of the way when the paper collection tray is not needed.

More specifically, the body of the stand supports first and second paper guides for guiding the paper from the platen area of the printer towards the collection tray for proper folding and stacking. The first guide comprises an upper guide and a lower guide for receiving the paper therebetween adjacent the platen area and guiding the same rearwardly through the lower portion of the stand body to a second guide which directs the paper upwardly and forwardly back through the body to direct the paper onto the collection tray.

According to the invention, the paper catcher is compatible with nearly every printer, with or without a printer stand, and with or without tractor feed, in that the adjustable height accommodates different printer designs and the guide structure receives the paper directly from the platen regardless of printer depth.

Advantageously, the space-saving paper catcher of the present invention is a self-storing structure in that there is no necessity of removing the catcher and storing the same when the catcher is not needed. As mentioned, the paper collection tray may be placed in a plurality of positions, including an upright or storage position. Also advantageous is the ability to see reports and the like as they are being printed in that the tray may be mounted in a position which is at an angle above the printer so that the printer head may be observed during printing. Also, and as an aid in guiding, folding and stacking, the guide structure is advantageously constructed of chrome steel and thermoplastics to provide a smooth, static-free operation.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
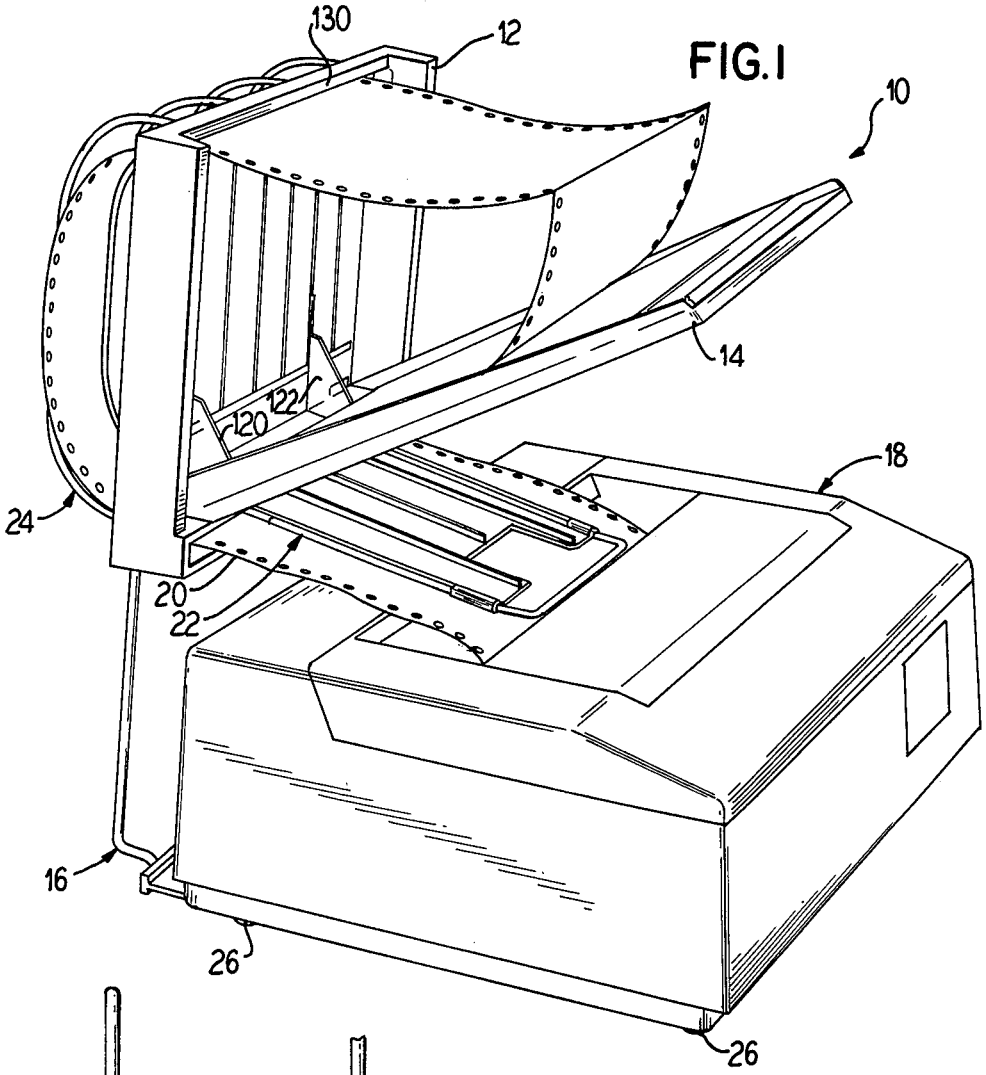
FIG. 1 is a perspective view of a printer and a paper catching apparatus constructed in accordance with the present invention.

Referring to FIG. 1, a paper collection structure is generally illustrated at 10 as comprising a stand body 12 mounted on a leg structure 16 and supporting a paper collection tray 14 for receiving fan-fold paper 20 by way of a first guide 22 and a second guide 24 via the body 12, as the paper 20 is fed from the platen area of a printer 18.

In order to best understand the various elements of the paper collection apparatus, and the functions and relationships of the elements, the same will be discussed in detail below with respect to each element and its relationship or relationships with other elements.

STAND

Leg Structure 16

Figure 2:
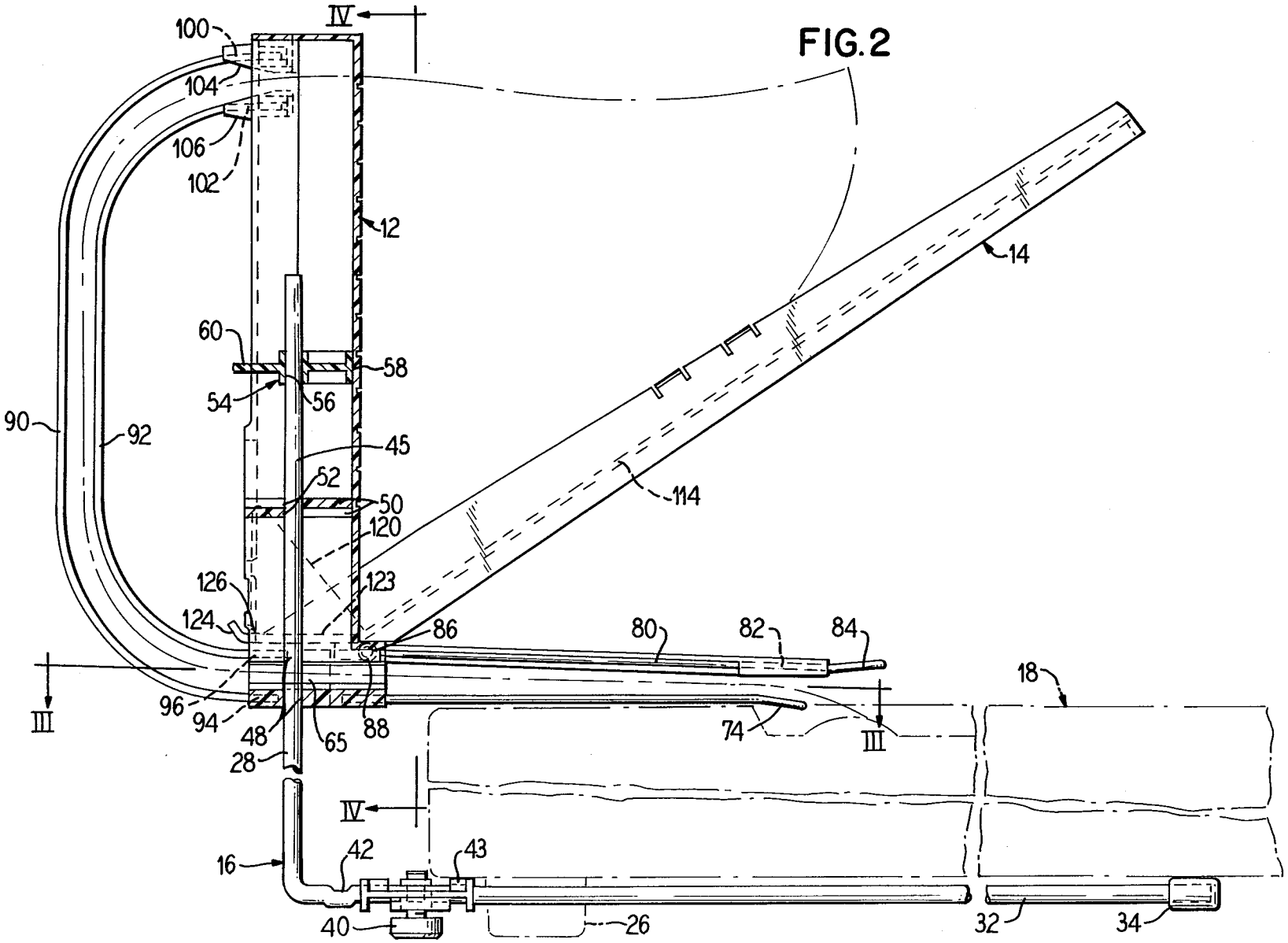
FIG. 2 is a fragmentary sectional view of the paper catching apparatus of FIG. 1 illustrating the angular position of the paper catching tray and the adjustable height structure of the stand body with respect to the stand legs, and further illustrating the cooperable relationship between the stand legs and the printer.
Figure 4:
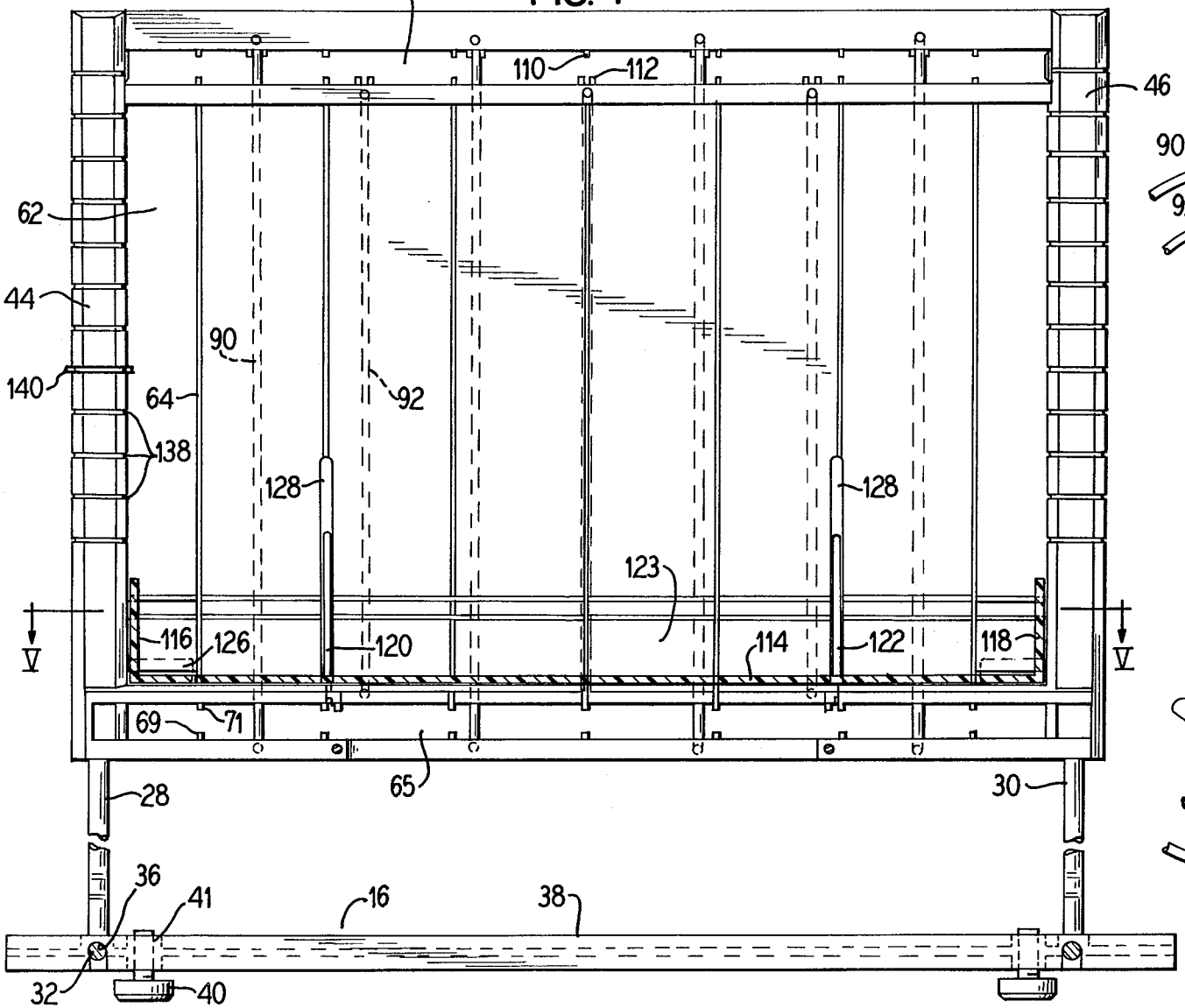
FIG. 4 is a front view of the paper catching apparatus shown with the paper collection tray in the horizontal position and as viewed along the line IV—IV of FIG. 2.

Referring first to FIGS. 1, 2 and 4, particularly FIGS. 2 and 4, the printer is shown as comprising a plurality of feet 26 which are conventionally resilient members.

The leg structure 16 is illustrated as comprising a pair of L-shaped legs 28 and 30 which extend upwardly into the stand body 12 and forwardly beneath the printer 18. The legs 28 and 30 are interconnected by way of a bar 38. Inasmuch as the structure is symmetrical with respect to connections to the body and to the bar, only the leg 28 will be discussed in detail. As shown on the drawing, the forward section 32 of the leg 28 extends through an aperture 36 in the bar 38 and is terminated at its distal end with a cap or rubber foot 34 which engages the lower surface of the printer 18. As is readily apparent, the bar may be positioned at any point between a crimp limit 42 and the rubber foot 34 to accommodate various depths of printers. When positioned with respect to the printer as illustrated, a screw 40 may be adjusted in a threaded bore 41 to secure the upper surface 43 of the bar against the lower surface of the printer.

As best seen in FIG. 2, the upper section 45 of the leg 28 is received in and locked to the body 12.

Body 12

Figures 5, 6, 8:
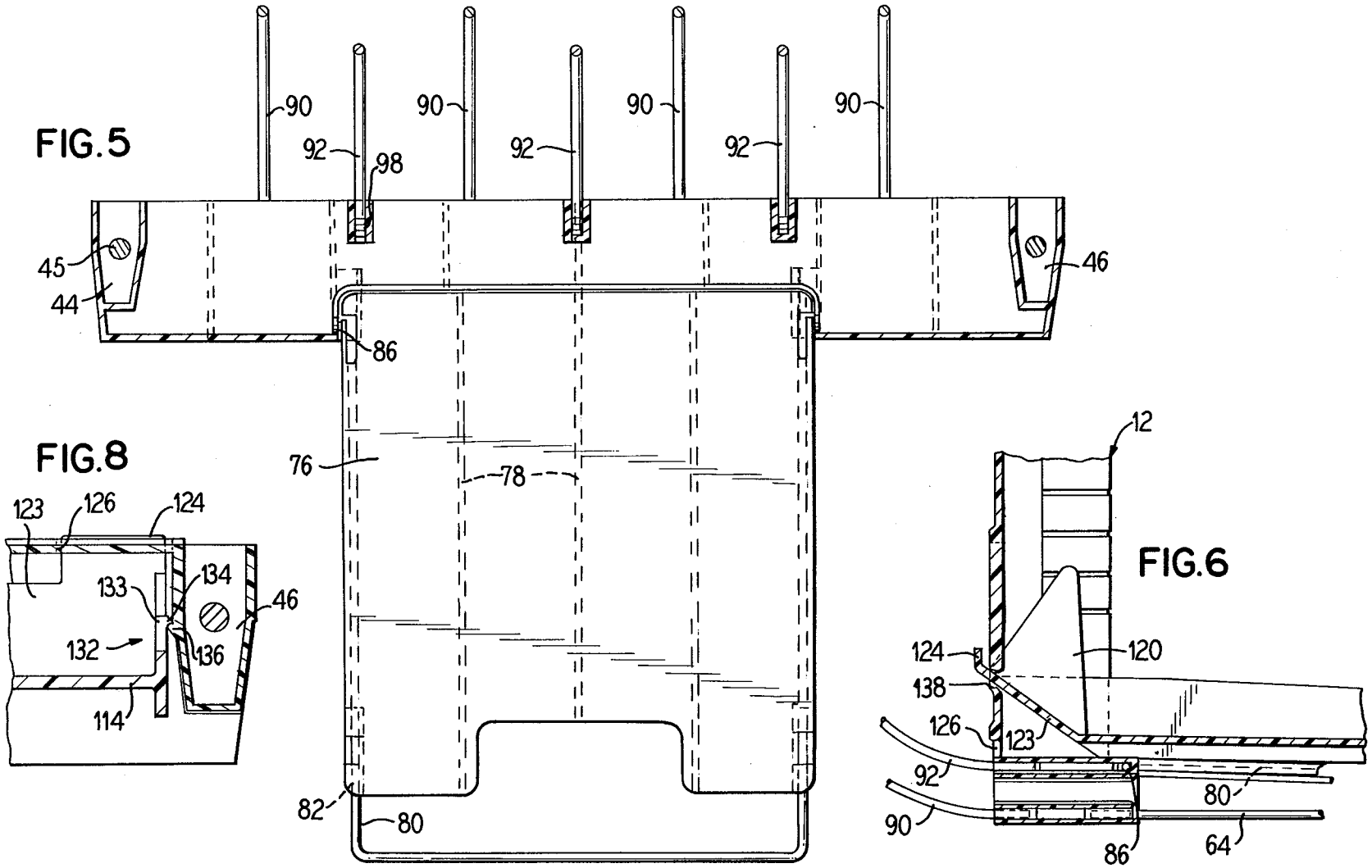
FIG. 5 is a top view taken generally along the line V—V of FIG. 4 showing the upper guide of the first guide structure.
FIG. 6 is a fragmentary sectional view illustrating the structure for holding the collection tray in the horizontal position.
FIG. 8 is a fragmentary sectional view illustrating the latching structure for holding the collector tray in the upright position, taken generally along the parting line VIII—VIII of FIG. 7.

Referring to FIGS. 2, 4 and 5, the body 12 comprises a generally rectangular structure including a pair of shaped end channels 44, 46, a rear wall 62 with ribs 64, a lower slot 65 for receiving the incoming paper and an upper slot 67 for discharging the paper towards the collection tray 14.

Again, inasmuch as there is symmetrical structure, only the relationship between the leg 28 and the channel 44 will be discussed below.

As best seen in FIG. 2, the upper section 45 of the leg 28 is received through at least one aperture 48 at the slot 65 and at least one aperture 52 in a member 50 spaced above the slot 65. These apertures may be in the form of a resulting circular aperture by providing a slot in one member cored from the rear and a slot in the adjacent member cored from the front inasmuch as the base is a molded structure. The center of the aperture 52 is preferably aligned with the center of the aperture 48, as each aperture is viewed as a circular aperture.

When the vertical height of the structure is set by moving the base 12 on the legs 28 and 30, a key is inserted into the channel 44, for example, and similarly into the channel 46, to lock the vertical height of the body 12. As shown in FIG. 2, a key 54 comprises an aperture 56 for receiving the leg section 45 therethrough. The key 54 has the same general peripheral configuration as the channel 44 (see FIG. 5) and comprises a surface 58 for engaging the inner surface of the channel. The key 54 also comprises a handle 60 for moving the key downwardly to lock the body to the leg structure. The locking action is achieved by offsetting the axis of the aperture 56 slightly rearwardly from the centers of the apertures 52 and 48 so that a wedging effect occurs as the key 54 is moved downwardly to wedge between the leg section 45 and the forward inner surface of the channel 44.

FIRST PAPER GUIDE

Referring to FIGS. 2, 3, 4 and 5, the first paper guide is seen as comprising a lower guide and an upper guide.

Figure 3:
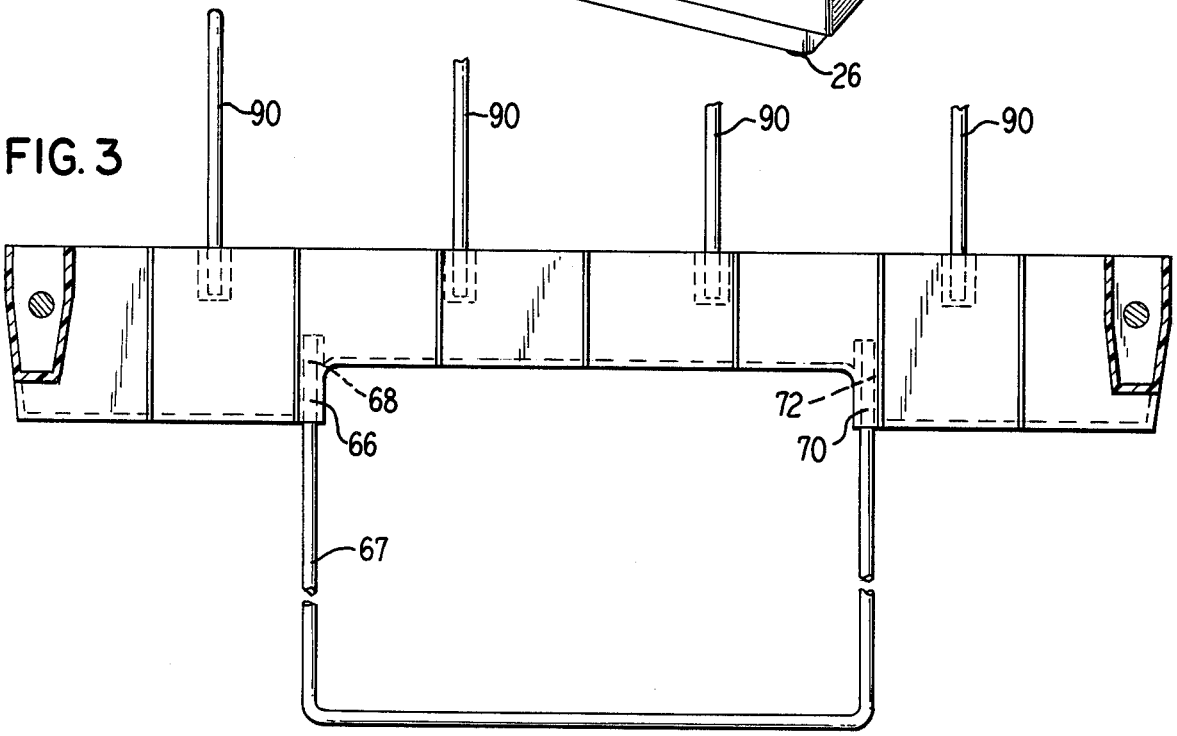
FIG. 3 is a sectional view taken generally along the line III—III of FIG. 2 showing the lower guide of the first guide structure.

Referring to FIG. 3, the lower guide is shown as comprising a U-shaped wire, preferably chrome steel, having a first end 66 received in an aperture 68 and a second end 70 received in an aperture 72 of the body 12. As shown in FIG. 2, a downwardly turned forward section 74 may be employed to direct the lower guide somewhat tangentially with respect to the platen. The upper guide, as best seen in FIGS. 2 and 5, comprises a generally rectangular planar body 76 with strengthening ribs 78 and a U-shaped wire form 80, preferably chrome steel, adjustably received through apertures 82 of the member 76. The body 12 comprises an aperture 88 for receiving a pivot axial 86 carried by the member 76. In FIG. 2 the upper guide has been shown spaced from the lower guide; however, with the pivot provided at 86, 88, the upper guide is free to ride on the upper surface of the paper 20 during operation. Advantageously, the member 76 may be a clear injection molded plastic material.

As with the lower guide, the wire form 80 may have a bent section 84 which functions as a skid, particularly with the upwardly pointed hinges of fan-fold paper as the same is discharged from the platen. Similarly, the section 74 of the lower guide will function in the same manner with respect to the downwardly-directed hinges of fan-fold paper.

SECOND PAPER GUIDE

Still referring to FIGS. 2-5, and in particular to FIGS. 2 and 4, the second paper guide is illustrated as comprising a plurality of wire forms 90, 92 which form a channel extending between the lower slot 65 and the upper slot 108. In the particular structure illustrated, four wire forms 90 are employed along with three wire forms 92 in an alternate pattern (see FIGS. 4 and 5). Of course, other patterns could be employed.

As best shown in FIG. 4, the lower slot 65 has a plurality of ribs 69 and 71 extending therethrough to decrease friction and the upper slot 108 has similar ribs 110, 112, again to decrease friction.

The wires 90 have their lower ends received in apertures 94 and their upper ends received in apertures 100 formed in bosses 104, while the wire forms 92 have their lower ends received in apertures 96 and their upper ends received in apertures 102 formed in bosses 106.

As shown in FIG. 5, all wires or wire forms which are received in apertures or bores may be provided with rib or serrated end sections as illustrated at 98 for a secure press fit.

Also, as all elements which are not wires are preferably injection molded, all apertures, recesses forming apertures and other openings and the like may be provided by front and rear coring as mentioned above.

PAPER COLLECTION TRAY 14

The paper collection tray 14 is a freely removable and repositionable collection tray and as best seen FIGS. 2 and 4 comprises a floor 114 extending between a pair of sidewalls 116 and 118. At the rear, the collection tray includes a pair of spaced members 120 and 122 extending from an oblique wall 123. At each end, the wall 123 includes a projection 124 which is received in a respective slot 126 to hold the collection tray in the angled position illustrated in FIG. 2.

Figure 7:
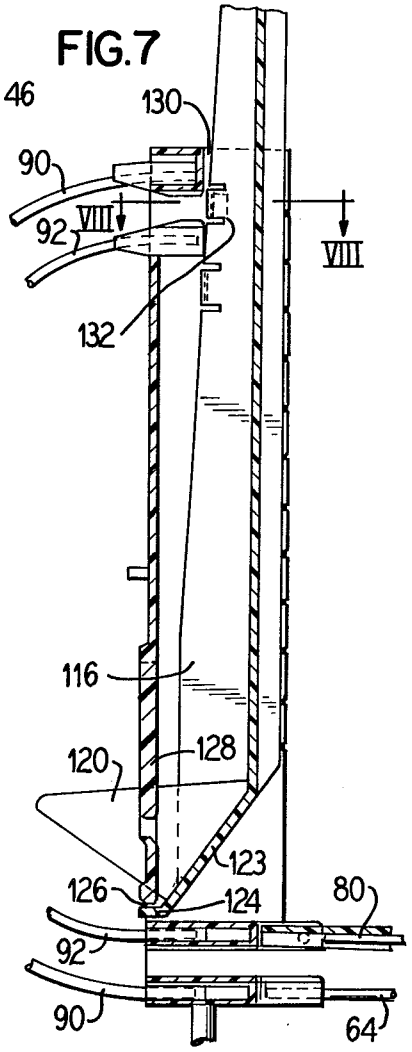
FIG. 7 is a fragmentary sectional view illustrating the collection tray in the upright or storage position.

Referring to FIGS. 7 and 8, the collection tray is illustrated in the upright or storage position. In this position, the projections 124 are still received in the recesses 126 with the upper portion of the tray located in a transverse recess 130 and secured therein by a latch mechanism 132.

In FIG. 8, the latch mechanism 132 is illustratd as comprising a resilient member 133 carrying a lip 134 which yieldably engages and latches behind a lip 136 formed on the wall of the channel 46. A similar structure is provided with respect to the channel 44.

Referring again to FIGS. 4 and 7, the wall 62 of the body 12 comprises a pair of slots 128 for receiving the members 120 and 122, respectively, when the collection tray 14 is in the upright or storage position.

Referring to FIG. 6, the collection tray is shown in the horizontal position in which the projections 124 are now received through slots or recesses 138 to bear against the rear surface of the body 12.

Many changes may be made in the paper collection apparatus described above. For example, rather than the key 54, a member 140 may be provided for each of the channels 44 and 46 and selectively received in slots 138 extending into the channels as limits for the upper ends of the legs 28 and 30. This structure, of course, would not be as rigid and as stable as that using the keys 54.

Although I have described my invention by reference to a particular illustrative embodiment thereof, many other changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A paper collecting apparatus for collecting, folding and stacking fan-fold paper as it is discharged from the platen of the printer which is carried on a support, comprising:

leg means to be carried on a support adjacent the printer;

a body mounted on said leg means;

a paper collection tray mounted on said body to extend over the top of the printer; and a paper guide means for receiving the moving paper from the platen and directing the moving paper onto the collection tray, said paper guide means comprising first channel means mounted on and extending from said body to a point adjacent the platen and defining a first paper channel for receiving the discharged paper, and second channel means including at least one passageway through said body and defining a second paper channel communicating with said first paper channel and a point above said paper collection tray so that the fan-fold paper refolds and stacks on the paper collection tray, said leg means comprising a pair of legs each including an upper section connected to said base and the lower section for engaging the support, a bar extending between connecting said legs, and a pair of feet adjustably secured to said bar for resting on the support and causing engagement of the bar with the lower surface of the printer.

2. The paper collecting apparatus of claim 1, wherein said body comprises:

first slot means defining a first slot in communication with said first channel means; and second slot means defining a second slot as a part of said second channel means, said second slot opening at said point above said paper collection tray.

3. The paper collecting apparatus of claim 1, wherein said first channel means comprises:

a first paper guide extending from said body to a point adjacent the platen to receive the fan-fold paper thereover; and a second paper guide extending from said body along said first guide for receiving the fan-fold paper thereunder.

4. The paper collecting apparatus of claim 3, wherein:

each of said first and second guides comprises a distal end extending at an angle away from the other guide.

5. The paper collecting apparatus of claim 3, wherein:

said second paper guide is pivotally connected to said body to rest on the top of the fan-fold paper.

6. The paper collecting apparatus of claim 1, wherein said second channel means comprises:

first slot means defining a first slot through said body in communication with said first channel means;

second slot means defining a second slot through said body; and channel means connected to said body and defining a paper guiding channel between said first and second slots.

7. The paper collecting apparatus of claim 1, wherein:

said paper tray comprises a floor, an end wall extending from said floor and a projection extending from said end wall; and said body comprises an aperture for receiving said projection at a location at which said floor extends at an upward angle, with respect to horizontal, over the printer.

8. The paper collecting apparatus of claim 1, wherein:

said paper tray comprises a floor, an end wall extending from said floor and a projection extending from said end wall; and said body comprises an aperture for receiving said projection at a location at which said floor extends horizontally over the printer.

9. The paper collecting apparatus of claim 1, wherein:

said paper tray comprises a floor, an end wall extending from said floor and a projection extending from said end wall; and said body comprises an aperture for receiving said projection at a location at which said floor extends vertically with respect to the printer.

10. The paper collecting apparatus of claim 9, and further comprising:

latch means including first and second latch elements respectively carried by said paper collection tray and by said body for releasably latching said paper collection tray in a vertical position.

11. The paper collecting apparatus of claim 10, wherein said latch means comprises:

a resilient hook means on said tray; and a hook means on said body releasably engaged by said resilient hook means.

12. The paper collecting apparatus of claim 1, wherein said second channel means comprises: first and second pluralities of generally U-shaped wires connected to said body spaced apart and defining at least a portion of said second paper channel.

13. The paper collecting apparatus of claim 7, wherein:

said leg means comprises a rod; and further comprising connection means connecting said rod to said body.

14. The paper collecting apparatus of claim 13, wherein said connection means comprises:

at least one aperture in said body for slidingly receiving said rod therethrough; and fixing means for fixing said body at a predetermined height with respect to said rod.

15. The paper collecting apparatus of claim 14, wherein said fixing means comprises:

a plurality of vertically spaced slots in said body; and a key for selective disposition in one of said slots to engage the distal end of said rod.

16. The paper collecting apparatus of claim 14, wherein said fixing means comprises:

channel means defining a vertical hollow channel in said body including a first surface;

aperture means defining an aperture in said body for receiving said rod therethrough including a predetermined center axis; and a key including an aperture for receiving said rod therethrough, a second surface for slidingly engaging said first surface and an axis offset of said aperture from the center axis to provide a wedging effect with said first and second surfaces to lock said rod against the edges of said apertures.

17. A paper collecting apparatus for collecting, folding and stacking fan-fold paper as it is discharged from the platen of a printed which is carried on a support, comprising:

leg means to be carried on a support adjacent the printer;

a body mounted on said leg means;

a paper collection tray mounted on said body to extend over the top of the printer; and a paper guide means for receiving the moving paper from the platen and directing the moving paper onto the collection tray, said paper guide means comprising first channel means mounted on and extending from said body to a point adjacent the platen and defining a first paper channel for receiving the discharged paper, and second channel means including at least one passageway through said body and defining a second paper channel communicating with said first paper channel and a point above said paper collection tray so that the fan-fold paper refolds and stacks on said paper collection tray, said leg means comprising a pair of legs each including an upper section releasably connectible to said base, a lower section for engaging the support, and a bar extending between said legs and pivotably connected to said legs.

18. The paper collecting apparatus of claim 17, wherein:

each of said legs comprises a distal end for engaging the lower surface of the printer.

19. Apparatus for collecting fan-fold paper which is continuously fed from the platen of a printer having a front, a top, a rear and a bottom, comprising:

a paper collection tray; and mounting means mounted said paper collection tray above the top of the printer, said mounting means including guide means defining a paper travel channel extending form the platen to a point above said paper collection tray for guiding the paper onto the collection tray;

said guide means comprising a generally, vertically extending body including a front, a rear, a top and a bottom;

first and second slots extending through said body adjacent said top and said bottom, respectively, each of said slots forming a respective part of said paper travel channel, ribs in said slots extending in the direction of paper travel, a plurality of first spaced apart U-shaped wires including upper ends connected to said rear of said body above said first slot and lowering ends connected to said rear of said body below said second slot, and a plurality of second spaced apart U-shaped wires including upper ends connected to the rear of said body below said first slot and lower ends connected to said rear of said body above said second slot, said first and second wires spaced from one another to form a portion of said paper travel channel.

20. The apparatus of claim 19, wherein:

said guide means comprises means further defining said paper travel channel along a path which extends in a loop above the printer.

21. Apparatus for collecting, folding and stacking fan-fold paper continuously delivered from the platen of a printer, comprising:

paper collection means for receiving the fan-fold paper;

mounting means mounted said paper collection means above the printer; and guide means mounted on said monting means and adjustably extending from a point adjacent the platen to a point above said paper collection means, including a pivotal paper channel for receiving the fan-fold paper, said guide means guiding the continuously delivered paper to said paper collection means so that the fan-fold paper refolds and stacks itself on said paper collection means.

22. Apparatus for collecting, folding and stacking fan-fold paper continuously delivered from the platen of a printer, comprising:

paper collection means for receiving the fan-fold paper;

mounting means mounting said paper collection means above the printer; and guide means mounted on said mounting means and adjustably extending from a point adjacent the platen to a point above said paper collection means, including a pivotal paper channel for receiving the fan-fold paper, said guide means guiding the continuously delivered paper to said paper collection means so that the fan-fold paper refolds and stacks itself on said paper collection means, said mounting means comprising a body including first and second slots, a first paper guide communicating with said first slot and including a distal end adjustably positionable for receiving the paper from said platen, and a second paper guide communicating with said first and second slots for receiving the paper from said first slot and guiding the paper to said second slot, said second slot positioned to direct the paper onto said paper collection means.

23. The apparatus of claim 22, wherein said second paper guide comprises:

a plurality of spaced apart U-shaped wires including upper ends connected to said the rear of said body above said first slot and lower ends connected to the rear of said body below said second slot; and a plurality of second spaced apart U-shaped wires including upper ends connected to the rear of said body below said first slot and lower ends connected to the rear of said body above said second slot, said first and second wires spaced from one another to form a paper travel channel.

24. The apparatus of claim 22, wherein said second paper guide comprises:

a plurality of first and second spaced apart U-shaped wires connected to the rear of said body and spaced from one another to form a paper travel channel.

* * * * *